US010161704B1

(12) United States Patent
Lee

(10) Patent No.: US 10,161,704 B1
(45) Date of Patent: Dec. 25, 2018

(54) FIREARM ADAPTER CONFIGURED TO MOUNT TO A FIREARM FRAME

(71) Applicant: Darryl S. Lee, Fort Myers, FL (US)

(72) Inventor: Darryl S. Lee, Fort Myers, FL (US)

( * ) Notice: Subject to any disclaimer, the term of this patent is extended or adjusted under 35 U.S.C. 154(b) by 0 days.

(21) Appl. No.: 15/674,622

(22) Filed: Aug. 11, 2017

(51) Int. Cl.
*F41A 21/32* (2006.01)

(52) U.S. Cl.
CPC ..... *F41A 21/325* (2013.01)

(58) Field of Classification Search
CPC ..... F41A 21/00; F41A 21/30–21/42; F41A 33/02; F41A 35/04; F41G 11/002–11/003
USPC ..... 42/116, 121, 124–128, 134; 89/14.2–14.4; 181/217, 223
See application file for complete search history.

(56) References Cited

U.S. PATENT DOCUMENTS 1,171,242 A * 2/1916 Prather ..... F41A 21/30 89/14.4
2,805,602 A * 9/1957 Moore ..... F41A 21/26 89/14.5
3,257,108 A * 6/1966 Pachmayr ..... F41A 21/40 269/45
4,479,418 A * 10/1984 Beretta ..... F41A 21/30 89/14.4
4,641,451 A * 2/1987 Harris ..... F41A 23/08 42/85
4,944,213 A * 7/1990 Ewert ..... F41A 21/325 89/14.3
5,136,924 A * 8/1992 Forster ..... F41A 21/30 89/14.4
6,223,458 B1 * 5/2001 Schwinkendorf ..... F41A 21/00 42/1.06
7,194,836 B1 * 3/2007 Urban ..... F41C 27/22 42/106
7,578,090 B1 * 8/2009 Romaszka ..... F41C 27/16 42/85
8,291,805 B1 * 10/2012 Quilligan ..... F41A 21/325 285/305
8,631,602 B2 * 1/2014 Chupp ..... F41G 11/003 42/71.02
8,667,727 B2 * 3/2014 Engelhardt ..... F41G 11/003 42/124
9,784,519 B2 * 10/2017 Fischer ..... F41G 11/003
(Continued)

FOREIGN PATENT DOCUMENTS

WO WO-2017102012 A1 * 6/2017 ..... F41A 21/325

*Primary Examiner* — Troy Chambers
*Assistant Examiner* — Benjamin S Gomberg
(74) *Attorney, Agent, or Firm* — Nicholas Pfeifer; Smith & Hopen, P. A.

(57) ABSTRACT

A universal firearm adapter configured to mount to the frame of a firearm. The adapter easily, quickly, accurately, securely, concentrically and repeatably, with or without tools, attaches a suppressor or suppressor adapter to the frame or rail system of a firearm. The adapter includes a rail attachment configured to attach to a plurality of dimensionally inconsistent frames/rails and a bore alignment assembly. Moreover, the adapter is configured to axially align the adapter bore with the barrel bore regardless of the dimensional and axial inconsistencies of the barrel and its bore. The bore alignment assembly preferably includes a suppressor mount axially aligned with the adapter bore thereby ensuring that the suppressor is axially aligned with the bore of the barrel.

8 Claims, 11 Drawing Sheets

(56) References Cited

U.S. PATENT DOCUMENTS

2015/0362276 A1* 12/2015 Fischer ..... F41G 11/003
89/14.4

* cited by examiner

FIREARM ADAPTER CONFIGURED TO MOUNT TO A FIREARM FRAME

BACKGROUND OF THE INVENTION

1. Field of the Invention

This invention relates, generally, to firearm adapters. More specifically, it relates to a firearm adapter configured to mount to the frame of a firearm and axially align with the firearm barrel.

2. Brief Description of the Prior Art

Firearm accessories have grown in popularity with the evolution of firearms. Over the years these accessories have been attached to firearms through various means, most of which require permanently altering the firearm. For example, attachment of suppressors (a.k.a. silencers) typically require a gunsmith to add external threads to the muzzle end of the firearm barrel to provide a mount on which the suppressor may threadedly engage. Another example, which has become increasingly popular is the attachment of rail system 104 to the surface of a firearm 102, as depicted in FIGS. 2-3. Typically, rail systems 104 comprise equidistantly-spaced laterally-extending strips of metal 106 secured to the existing frame of firearm 102 creating lateral slots 108, on which various accessories can be secured. Rail system 104 also includes longitudinally extending rail slots 107 established by rail extension 109, sometimes referred to as a "dovetail extension" or a "T-shaped extension," on the underside of rail system 104.

Unfortunately, rail systems often have inconsistent dimensions and will vary in size, shape, and dimension between firearms. The firearm industry has not established a universal standard for rail system dimensions and most are aftermarket modifications lacking the consistencies that might be present if the rail systems were originally manufactured as part of the firearm frame. Thus, a firearm adapter configured to mount to any rail system must account for these dimensional inconsistencies.

As explained above, suppressors typically threadedly engage a modified barrel. This attachment method, however, comes with additional complications when the firearm employs a "floating" barrel housed within a slide (a.k.a. a "locked breech barrel"), such as the Glock firearms. The floating barrel is intended to aid in the feeding of projectiles into the barrel by allowing the proximal end of the barrel to drop vertically towards the handle of the firearm when the slide is retracted after the weapon is fired. The dropping of the proximal end creates a positively sloped barrel moving in a distal direction. The sloped barrel generally mirrors the sloped orientation of the projectiles in the magazine. As a result, the next projectile in the magazine easily slides into the barrel when the slide moves back into a firing position.

If a suppressor is attached to the muzzle end, i.e. distal end, of the floating barrel, the weight of the suppressor prevents the barrel from dropping into a positively sloped orientation when the slide retracts and ultimately the barrel ends up in a negatively sloped position placing the barrel out of alignment with the projectile in the magazine. As the slide attempts to move back into a firing position, the angled projectile is unable to slide into the proximal end of the barrel and the weapon jams.

There have been attempts to attach suppressors to firearms using adapters configured to attach to the frames of firearms. For example, U.S. Pat. No. 7,194,836 to Urban, discloses a firearm adapter configured to mount to the frame of the firearm by hanging from the muzzle end of the frame, engaging the trigger guard with a set screw, and engaging a laterally extending pin that is either preexisting or an aftermarket addition to the frame of the firearm. This method, however, creates another potentially catastrophic issue revolving around the alignment of the barrel and the suppressor attached to the adapter.

As already explained, rail systems have inconsistent dimensions. Moreover, firearm dimensions vary slightly among firearms of the same model and can vary drastically between firearms of different models and manufacturers. Furthermore, firearm barrels can vary in dimensions and alignment with respect to the firearm frame or slide, even among firearms of the same model. An example of this common issue is depicted in FIG. 1. As illustrated, firearm barrel 110 is off center with respect to aperture 112 in firearm slide 114, resulting in barrel bore 103 being misaligned with aperture 112 and ultimately the longitudinal axis of firearm slide 114.

Thus, suppressors that rely on an adapter secured to the frame of a firearm must be designed for a specific firearm's dimensions, and it is unlikely that said suppressor will axially align with the barrel bore of another firearm when the adapter is secured thereto. In other words, a universal suppressor attachment configured to mount to the frame of a plurality of different firearms must overcome variations in not only the dimensions of the firearms' frames, but also the variations in the locations of the barrel bores.

Accordingly, what is needed is a universal firearm adapter configured to mount to a plurality of firearm frames and axially align with varying firearm barrels. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a universal firearm adapter configured to mount to a plurality of firearm frames and axially align with varying firearm barrels. is now met by a new, useful, and nonobvious invention.

The novel structure includes a firearm adapter having a rail attachment, a vertical guide, and a bore alignment structure in in two-directional translational communication with the vertical guide. The rail attachment has a longitudinal extent and a female mounting channel configured to receive a portion of a frame of a firearm or a rail extension secured to the firearm. The vertical guide is in mechanical communication with the rail attachment and perpendicularly oriented with respect to the rail attachment. The bore alignment structure has a suppressor mount extending distally from a distally-facing surface and a bore extending through the bore alignment structure and the suppressor mount along a central axis that is parallel to the longitudinal extent of the rail attachment. The translational communication between the vertical guide and the bore alignment structure enables the bore alignment structure to move in both an X-direction and a Y-direction in a plane perpendicular to the longitudinal extent of the rail attachment to align the central axis of the bore with a central axis of a barrel of the firearm when the adapter is mounted to the firearm.

An embodiment includes the vertical guide having a male extension extending from a bottom surface that is configured to be securely received by the female mounting channel in the rail attachment. In another embodiment, the vertical guide is integrated into the rail attachment.

In an embodiment, the rail attachment includes a first cam lock and a second cam lock. The first cam lock is in communication with a first portion of the female mounting channel and adapted to reduce the width of the first portion of the female mounting channel when the first cam lock is placed into a locking position. Likewise, the second cam lock is in communication with a second portion of the female mounting channel and adapted to reduce a width of the second portion of the female mounting channel when the second cam lock is placed into a locking position.

An embodiment includes the bore in the bore alignment structure has an inner diameter equal to or greater than an inner diameter of the barrel of the firearm on which the firearm adapter is mounted.

An embodiment further includes a compressible grommet disposed on a proximal surface of the bore alignment structure and axially aligned with the bore in the bore alignment structure, thereby providing a cushion and seal between the bore alignment structure and the barrel of the firearm.

In an embodiment, the suppressor mount extends through the bore alignment structure. A spring platform extends radially outward from the suppressor mount on a portion of the suppressor mount that is located within an inner housing of the bore alignment structure. A spring is disposed between the spring platform and a distal internal surface of the bore alignment structure, and a proximal end of the suppressor mount extends proximally beyond the bore alignment structure and includes a compressible grommet secured thereto. The spring continually forces the compressible grommet into abutting relation with a muzzle end of the barrel of the firearm when the adapter is mounted to the firearm, such that the grommet remains in abutting relation as the barrel cycles when discharged. Resultantly, slower moving gases, that typically exit the barrel when the firearm is cycling, are captured by the suppressor mount abutting the firearm barrel.

In an embodiment, the suppressor mount is rectangular in shape and has a detent configured to engaged a detent orifice in a suppressor.

An embodiment of the vertical guide has a pair of enclosure arms extending oppositely around the rail attachment. Each enclosure arm has a free end terminating at a longitudinal plane of symmetry about the vertical guide forming a sight line for aiming.

An embodiment of the present invention is a firearm adapter assembly comprising an adapter and a suppressor. The adapter includes a rail attachment and a vertical guide in mechanical communication with the rail attachment and perpendicularly oriented with respect to the rail attachment.

The rail attachment has a longitudinal extent and a female mounting channel configured to receive a portion of a frame of a firearm or a rail extension secured to the firearm. The vertical guide has two upright support members laterally spaced from each other and terminating at free ends to establish an open central cavity.

The suppressor is in mechanical communication with the vertical guide and adapted to translate with respect to the rail attachment in both an X-direction and a Y-direction in a plane perpendicular to the longitudinal extent of the rail attachment to align the central axis of a bore in the suppressor with a central axis of a barrel of the firearm.

An embodiment of the assembly further includes the suppressor having a vertical guide receipt having a width greater than a distance between outer lateral surfaces of the upright support members of the vertical guide, thereby allowing the suppressor to translate in the X-direction. An embodiment also includes a projectile channel extending between a suppressing section of the suppressor and a proximal end of the suppressor and passing through the vertical guide receipt.

An embodiment of the assembly may include a bore alignment structure. The bore alignment structure has a suppressor mount extending distally from a distal-facing surface and a bore extending through the bore alignment structure and the suppressor mount. The bore has a central axis that is parallel to the longitudinal extent of the rail attachment, and the bore alignment structure is in communication with the suppressor via the suppressor mount and is in communication with the vertical guide.

An embodiment of the assembly having a bore alignment structure may further include the suppressor mount extending through the bore alignment structure. A spring platform extends radially outward from the suppressor mount on a portion of the suppressor mount that is located within an inner housing of the bore alignment structure. A spring is disposed between the spring platform and a distal internal surface of the bore alignment structure, and a proximal end of the suppressor mount extends proximally beyond the bore alignment structure and includes a compressible grommet secured thereto. The spring continually forces the compressible grommet into abutting relation with a muzzle end of the barrel of the firearm when the adapter is mounted to the firearm, such that the grommet remains in abutting relation as the barrel cycles when discharged. Resultantly, slower moving gases, that typically exit the barrel when the firearm is cycling, are captured by the suppressor mount abutting the firearm barrel.

An embodiment of the suppressor has a residual gas receipt disposed in a proximal end of the suppressor. The residual gas receipt has inwardly sloping walls to direct gases into an exhaust chamber and then through at least one exhaust port in a lateral side of the suppressor.

The suppressor may have a rectangular shape. Moreover, the suppressor may include an external access in a lateral surface of the suppressor providing access to the vertical guide in the vertical guide receipt.

An embodiment of the present invention is a novel method for securing a suppressor to a firearm. The method includes securing a rail attachment to a portion of a frame of a firearm or a rail extension secured to the firearm. The method further includes inserting a bore alignment device into a bore in a suppressor or a bore in a bore alignment structure. The bore alignment structure or the suppressor are in mechanical communication with the rail attachment device and can translate in both an X-direction and a Y-direction in a plane that is perpendicular to a longitudinal extent of the rail attachment.

The bore alignment device has a base rod member having a first end with a stop and a second end. The bore alignment device includes a compression sleeve ensleeving the base rod, that is adapted to increase in width when subject to axial forces. A compression nut engages the second end of the rod and adapted to apply an axial force to the compression sleeve when translated towards the stop at the first end of the base rod.

The novel method further includes the steps of adjusting a location of the suppressor or the bore alignment structure to axially align with the bore in firearm barrel and then forcing the bore alignment device into the bore in the firearm barrel. The compression nut is then translated towards the stop at the first end of the base rod thereby expanding the width of the compression sleeve. The expansion of the width of the compression sleeve causes the bore in the suppressor or the bore alignment structure to axially align with the bore in the barrel of the firearm. Once aligned, the location of the suppressor or the bore alignment structure is secured with respect to the rail attachment. Finally, the compression nut is translated away from the stop at the first end and the bore alignment device is removed from the bore in the barrel of the firearm and the bore of the suppressor or the bore alignment structure.

It is an object of the invention to provide a device allowing shooters to safely, securely, easily, and inexpensively fit or retrofit a suppressor, to a multitude of firearms having various geometries via an omnidirectionally adjustable, rail attachable adapter. The fitment to multiple firearm makes, models, and geometries is accomplished using a single iteration of the present invention manufactured in a single size and attachable with or without tools.

An object of the invention is the elimination of cycling issues resulting from suppressors threaded onto the muzzle end of floating barrels by eliminating the need to attach a suppressor to the barrel.

Another object of the invention to provide a single suppressor adapter capable of being secured to both handguns and rifles.

An object of the invention is to provide a suppressor adapter that fits most firearms, is easy to install, and is easy to reattach with repeatability.

Another object of the invention is to provide a rail attachment device that can attach to different rails with varying lengths, widths, heights, slot widths, slot height, slot location, number of slots, distances of the slots from the muzzles of the barrels, and depths of rail grooves.

An object of the invention is providing a suppressor adapter capable of aligning the centerline of the suppressor or suppressor adapter to the centerline of the bore of the firearm.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention is a universal firearm adapter configured to mount to the frame of a firearm or a rail system on the frame of a firearm. The adapter of the present invention includes a frame or rail attachment (hereinafter referred to as "rail attachment") configured to attach to a plurality of dimensionally inconsistent frames/rails and a bore alignment assembly configured to axially align the adapter bore with the barrel bore regardless of the dimensional and axial inconsistencies of the barrel and its bore.

Figure 1:
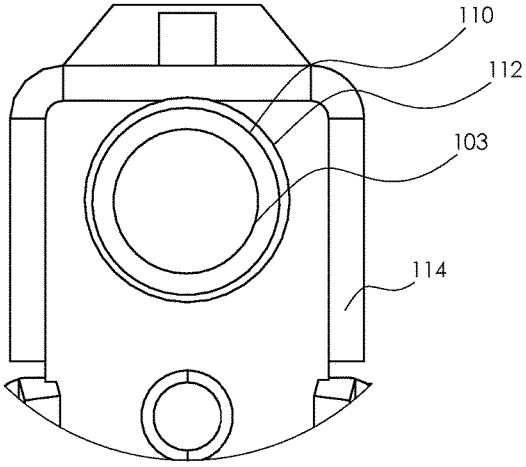
FIG. 1 (Prior Art)
FIG. 1 is a front view of a prior existing firearm having a barrel bore offset with respect to the centerline of the firearm.
Figure 3:
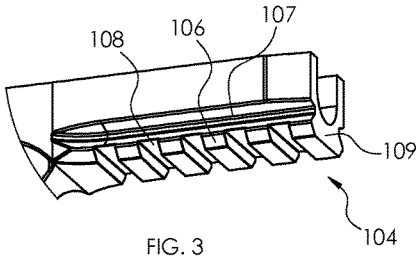
FIG. 3 (Prior Art)
FIG. 3 is a close-up view of the rail system in FIG. 2.
Figure 2:
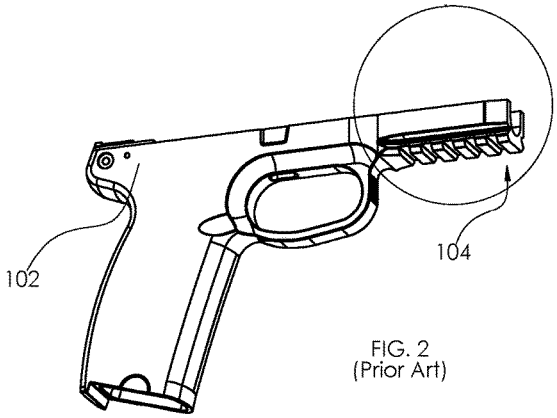
FIG. 2 (Prior Art)
FIG. 2 is a perspective view of a prior art rail system secured to the sub frame of firearm.

Referring to FIGS. 4-10, an embodiment of the firearm adapter, generally denoted by reference numeral 200, includes rail attachment 216 adapted to attach to the contours of the rail extension on a firearm similar to extension 109 in FIGS. 2-3. Adapter 200 further includes vertical guide 218 integrated with or adapted to attach to rail attachment 216 and bore alignment structure 220.

Figure 7:
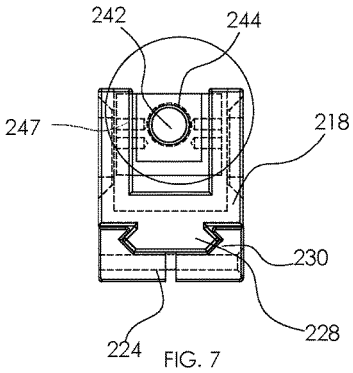
FIG. 7 is a top plan view of the embodiment in FIG. 4.

Rail attachment 216 preferably comprises of two longitudinally extending sections, collectively denoted by reference numeral 222. Sections 222 are in mechanical communication through, for example, fasteners 224 extending through apertures 226 in sections 222. Fasteners 224 maintain the adjacent orientation of sections 222 while also allowing said sections 222 to adjust in lateral spacing along the extent of fasteners 224, as most clearly depicted in FIGS. 7-9. Fasteners 224 are in communication with both sections 222, such that tightening of fasteners 224 causes sections 222 to come together and clamp around extension 109 of rail system 104 and/or around male extension 228 extending from vertical guide 218 as illustrated in FIG. 7. In other words, fasteners 224 and sections 222 produce a rail attachment with an adjustable width. An embodiment may rely on independent set screws on each section 222 rather than fasteners extending between sections 222 to secure said sections to a rail system.

It should be noted that while FIG. 7 illustrates rail attachment 216 clinching extension 228 from vertical guide 218, rail attachment 216 similarly clinches extension 109 from rail system 104. Extension 228 is designed to mirror the contours of the firearm frame or rail extension 109 such that rail attachment 216 can clinch both extensions within female mounting channel 230. Alternatively, vertical guide 218 is simply integrated or fastened to a portion of rail attachment 216 that does not interfere with the receipt of rail extension 109 in female mounting channel 230.

Female mounting channel 230 has a cross-sectional shape configured to match the contours of rail extension 109 and corresponding vertical guide extension 228. The exemplary rail design provided in the figures is a typical Picatinny rail, and thus, female mounting channel 230 is shaped to receive a Picatinny-shaped extension. The female mounting channel 230, however, may include a different cross-sectional shape to receive a rail extension/firearm frame having a shape other than the typical Picatinny shape. For example, Weaver rails employ a tenon shaped extension like those found in dovetail joints. Thus, female mounting channel 230 would have a cross-sectional shape similar to a dovetail receipt, commonly referred to as a "mortises" shape. Furthermore, female mounting channel 230 may have a simple open square-shaped receiving space with upper flanges extending inward towards the longitudinal axis of rail attachment 216. This simpler design can secure a rail extension of generally any shape without having to mirror a specific design. In other words, it is a more universal female mounting channel.

Figure 8:
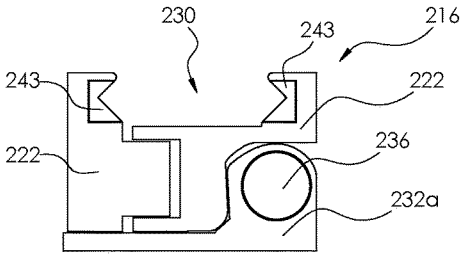
FIG. 8 is an end view of an embodiment of the rail attachment in a locked position.
Figure 9:
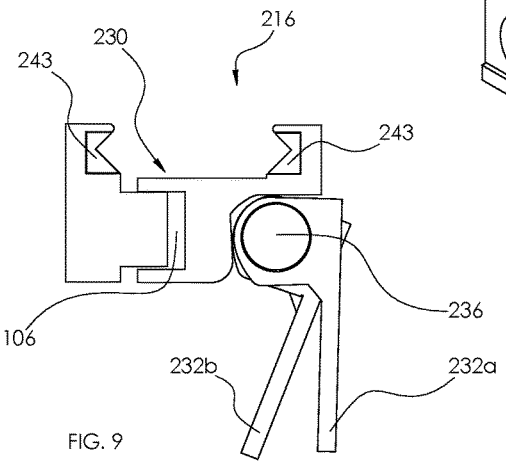
FIG. 9 is an end view of an embodiment of the rail attachment in an unlocked position.
Figure 10:
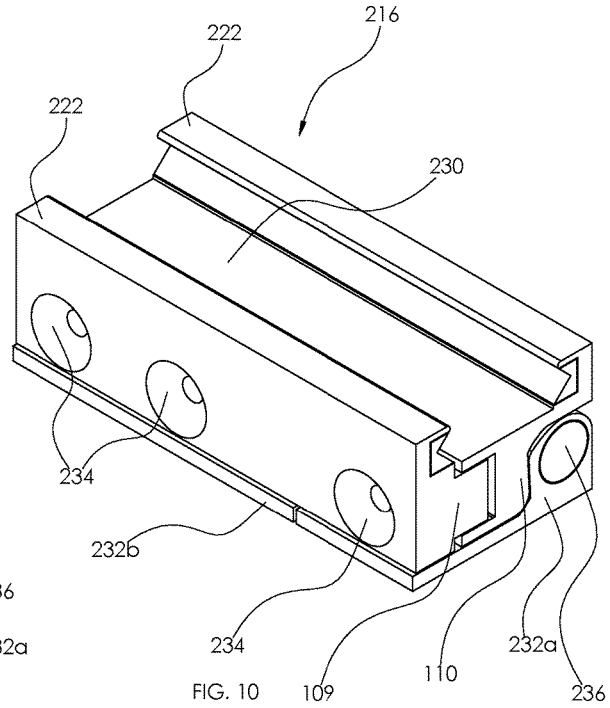
FIG. 10 is a perspective view of an embodiment of the rail attachment in a locked position.

Referring now to FIGS. 8-10, an embodiment of rail attachment 216 includes a quick release cam lock 232 for locking/unlocking rail attachment 216. Cam lock 232 simplifies the process of mounting and demounting adapter 200. As depicted in FIG. 8, cam lock 232 includes a closed configuration during which sections 222 are pulled inward towards each other to clamp around a rail, frame, and/or vertical guide extension. In the open configuration, as depicted in FIG. 9, cam 232 allows sections 222 to extend away from each other such that female mounting channel 230 expands in width to easily receive or separate from a rail, frame, and/or vertical guide extension.

As depicted in FIG. 10, cam lock 232 employs one or more fasteners 224, e.g. bolts, passing through through-holes 234 to bring cam 232 into mechanical communication with the section 222 that is laterally opposite from cam 232. Fasteners 224 threadedly engage axial pin 236 about which cam 232 rotates. Thus, the fasteners can reduce or increase the minimum, and resultantly the maximum, distances between the outer section 222 and axial pin 236. In other words, the fastener can be adjusted to alter the width of the female mounting channel when the cam lock is in an unlocked open configuration, and resultantly alter the width of the female mounting channel when the cam lock is in the locked position. As a result, the cam lock 232 becomes an effective fastening tool for a wider range of rail dimensions.

Figure 11:
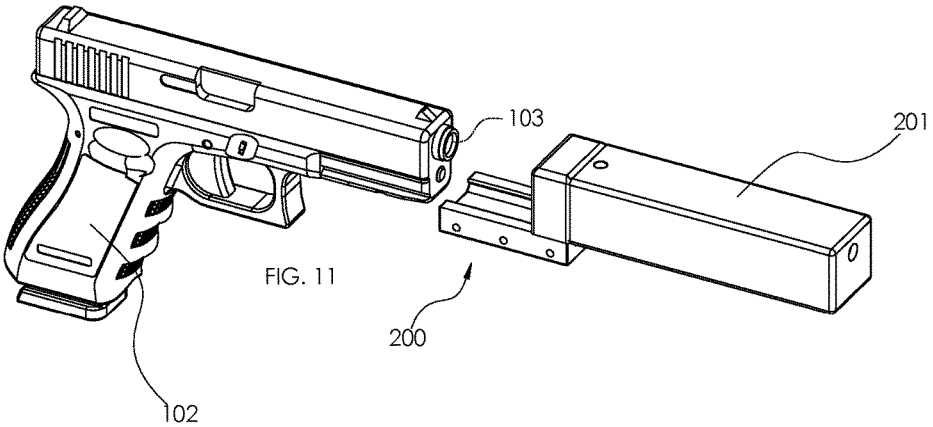
FIG. 11 is an assembly view depicting an embodiment of the adapter disassembled from a hand gun.
Figure 12:
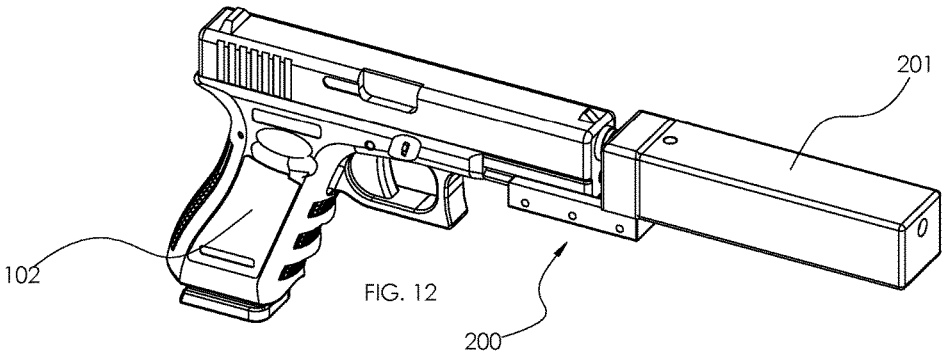
FIG. 12 is a perspective, assembled view of the embodiment depicted in FIG. 11.

Referring now to FIGS. 9-10, an embodiment may include two independent cam locks 232*a*, 232*b*. Two independent cam locks allow a user to secure a vertical guide through cam lock 232*a* and then independently secure attachment rail 216 to a rail extension or firearm frame using cam lock 232*b*. This configuration allows a user to attach adapter 200 to a firearm, align the adapter to the bore of the firearm barrel and then detach adapter 200 from the firearm without also detaching the vertical guide. In other words, adapter 200 and in turn suppressor 201 can be set to perfectly align to a specific firearm 102 and then adapter 200 can be removed when needed without altering the alignment of adapter 200 and in turn suppressor 201 to firearm 102, which is illustrated in FIG. 11. Adapter 200 can then be easily reattached to firearm 102 as depicted in FIG. 12 without having to make any adjustments to the alignment pf adapter 200 or suppressor 201 with the firearm barrel. Once set up, the adapter detaches and reattaches with a single cam lever. There is no requirement to disassemble a firearm to change out a threaded barrel.

The cam lock(s) and the corresponding clamping means for mounting the adapter 200 to a firearm is also beneficial because the rail attachment can be mounted at any location along the longitudinal axis of the firearm's frame or rail system. Unlike existing systems, the rail attachment of the present invention is not dependent on the size and spacing of rail slots or the length of the rail. Rather, the adapter's ability to attach to the firearm's frame or rail system at any point about the firearm or rail's length allows a user to adjust the longitudinal position of the bore alignment structure 220, and in turn a suppressor, with respect to the muzzle end of the barrel.

An embodiment of rail attachment 216, as depicted in FIGS. 8-10, includes friction pads 201 on the lateral sides of female mounting channel 230. Friction pads 243 preferably comprise of a compressible material intended to aid in the clamping force of the rail attachment and/or have a coefficient of friction greater than the coefficient of friction of the material making up the firearm frame or rail extension. Another benefit of the compressible nature of friction pads 243 that friction pads 243 will conform to mate with firearm frames and rail extensions having various shapes and dimensions. Furthermore, the softer compressible material will not damage the firearm.

In an embodiment, friction pads 243 either help create the shape of the female mounting channel or are simply disposed on the surfaces of the female mounting channel 230 to engage the lateral edges of the rail extension. It is understood that friction pads 243 may be secured on any surface designed to come in contact with the firearm frame or rail extension.

It should be understood that the rail attachment may use any mechanical fasteners to clamp or secure to a firearm frame or rail extension. Preferably, the female mounting channel will be adjustable in width to account for variations in the dimensions of firearm frames and rail extensions, however, a rail attachment may have a fixed-width female mounting channel.

Referring back to FIGS. 4-7, adapter 200 includes vertical guide 218 having male extension 228 shaped and dimensioned to be received by rail attachment 216 in female mounting channel 230. Excluding male extension 228, vertical guide 218 is generally U-shaped with channels 238 disposed in the upright supports of the U-shaped structure. Channels 238 are dimensioned to receive lateral flanges 240 extending from bore alignment structure 220.

Figure 5:
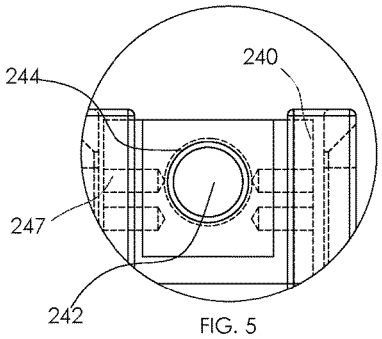
FIG. 5 is a close-up view of the bore alignment structure.
Figure 6:
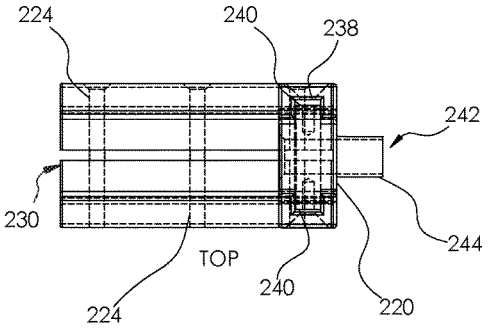
FIG. 6 is a front, end view of the embodiment in FIG. 4.

As depicted best in FIG. 6, bore alignment structure 220 has an overall width (i.e. distance between the lateral surfaces of lateral flanges 240) that is less than the distance between the lateral surfaces of channels 238. Bore alignment structure 220 is therefore able to translate in a lateral direction within vertical guide 218, which is illustrated in FIGS. 5-7 in which bore alignment structure 220 is offset closer to one of channels 238.

As best shown in FIG. 7, bore alignment structure 220 has a height that is less than the height of the U-shaped cavity within vertical guide 218. Thus, bore alignment structure 220 can be raised and lowered in height to vertically align bore 242 with the center axis of barrel bore 103.

Combining the ability of bore alignment structure 220 to translate in the lateral and vertical directions (X and Y directions in a plane perpendicular to the longitudinal axis of rail attachment 216), the bore alignment structure 220 can be precisely positioned such that bore 242 is axially aligned with bore 103 in a firearm barrel.

An embodiment of bore alignment structure 220 includes a suppressor mount 244 axially aligned with bore 242 on which a suppressor may be mounted. In an embodiment, the mount includes external threads on which the suppressor can threadedly engage. Alternatively, the suppressor mount may include other attachment methods known to a person of ordinary skill in the art, such as detents or set screws.

Figure 4:
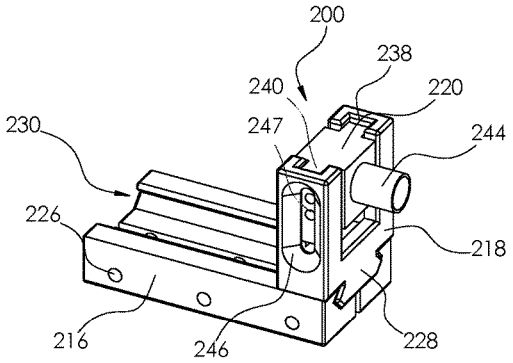
FIG. 4 is a perspective view of an embodiment of the present invention.

As depicted in FIG. 4, an embodiment includes external accesses 246 disposed in the vertical arms of U-shaped vertical guide 218. External accesses 246 provide an opening through which fasteners, such as set screws, can pass and engage bore alignment structure 220 to secure bore alignment structure 220 at a desired location. Accesses 246 may also be beveled as depicted to provide a surface on which the fasteners can seamlessly mount. In an embodiment, bore alignment structure 220 includes one or more threaded fastener apertures 247 for receiving fasteners when setting the location of bore alignment structure 220 about vertical guide 218.

Referring now to FIGS. 13-17, an embodiment of the adapter of the present invention, generally denoted by reference numeral 300, includes bore alignment structure 320 adapted to internally receive vertical guide 318. Vertical guide 318 is again generally U-shaped to avoid obstructing bore 342 and the projectile that passes through bore 342 when the firearm is fired. Moreover, the total width of vertical guide 318 is less than the total internal width of bore alignment structure 320 to allow bore alignment structure 320 to move in a lateral direction with respect to vertical guide 318.

Figure 14:
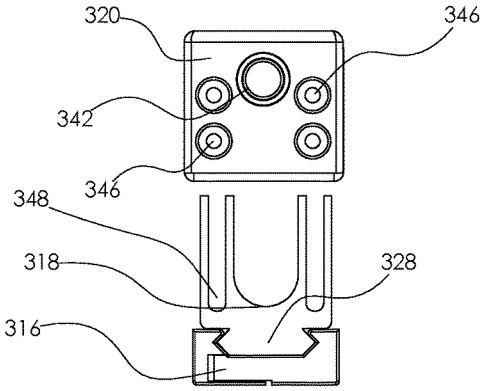
FIG. 14 is a front, end view of the embodiment in FIG. 13 partially assembled.

As depicted most clearly in FIG. 14, the vertical arms defining the U-shaped structure of vertical guide 318 each include channel 348 for receiving fasteners that pass through external accesses 346. The fasteners are intended to have an outer diameter greater in magnitude than the width of channels 348. The fasteners are thus able to wedge between channels 348 to secure bore alignment structure 320 at a specific location with respect to the vertical guide 318. Alternatively, an embodiment doesn't include channels 348 and instead relies on set screws which pass through external accesses 346 and engage the upright support members of vertical guide 318.

Bore alignment structure 320 also includes one or more vertically spaced rows of external accesses 346. Said multiple rows of external accesses 346 provide varying heights at which bore alignment structure 320 can be secured to vertical guide 318. Thus, bore alignment structure 320 can be adjusted in height with respect to vertical guide 318.

Figure 15:
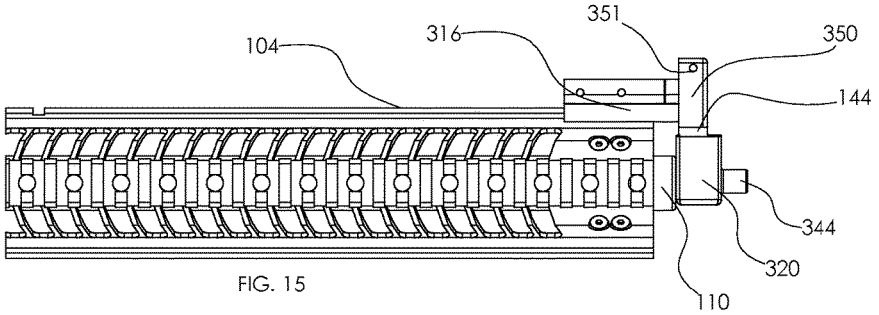
FIG. 15 is an elevation view of an embodiment of the present invention.
Figure 17:
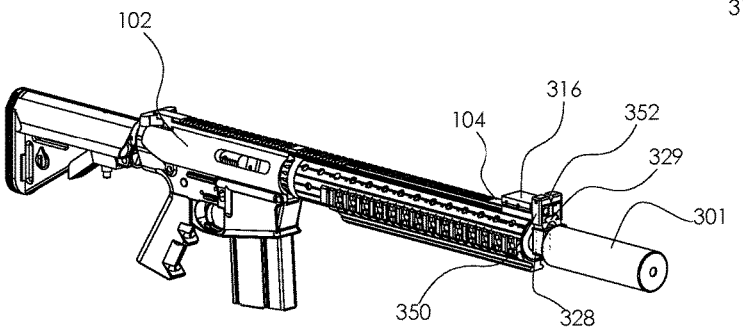
FIG. 17 is a perspective view of the embodiment depicted in FIG. 15.
Figure 16:
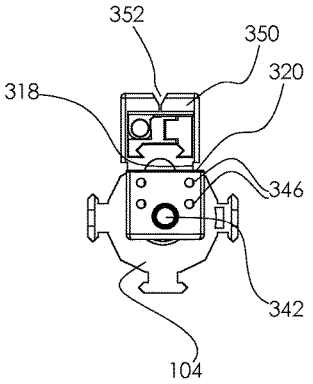
FIG. 16 is a front, end view of the embodiment depicted in FIG. 15.
Figure 18:
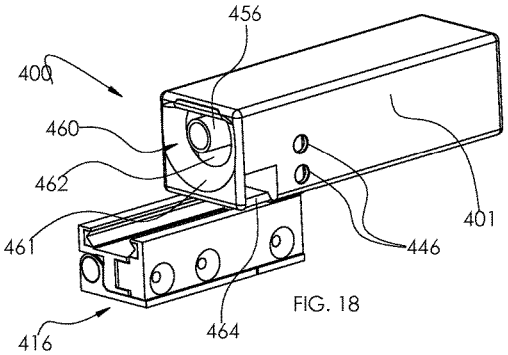
FIG. 18 is a perspective view of an embodiment of the present invention.
Figure 19:
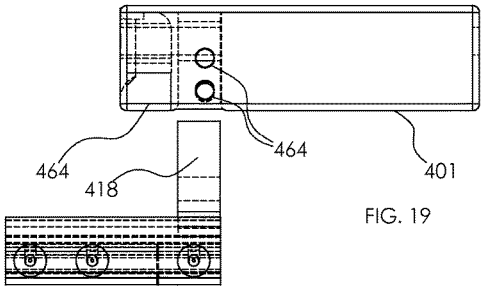
FIG. 19 is a partially disassembled view of the embodiment depicted in FIG. 18.
Figure 20:
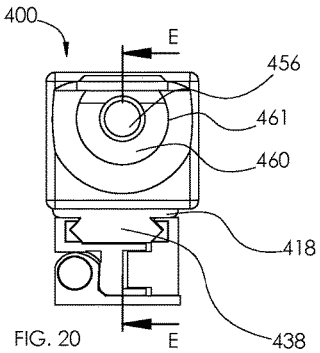
FIG. 20 is a rear, end view of the embodiment in FIG. 18.
Figure 21:
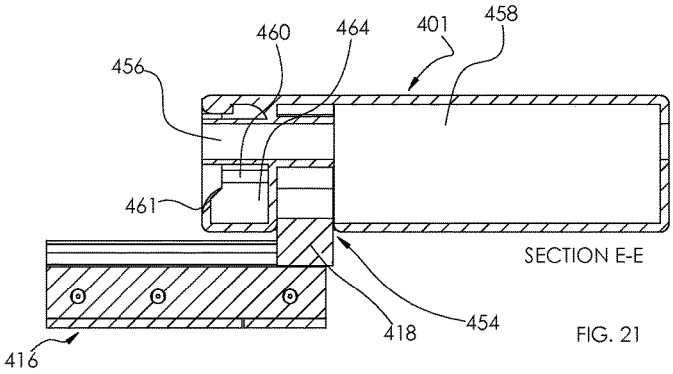
FIG. 21 is a sectional elevation view of the embodiment in FIG. 18.

Referring now to FIGS. 15-17, an embodiment of vertical guide 318 includes enclosure arms 350 creating a receipt through which rail attachment 316 is designed to reside. Enclosure arms 350 meet at a middle point and each includes fastener receipt 351 to receive a fastener adapted to lock enclosure arms 350 to each other to help secure vertical guide 318 to rail attachment 316. As depicted, the vertical guide 318 still includes male extension 328 to help with the attachment of vertical guide 318 to rail attachment 316, but it is not required.

In an embodiment, enclosure arms 350 each include a tapered section at their respective free ends where they meet to establish sight groove 352 for aiming the firearm. Rail systems on long barrel firearms (a.k.a. rifles) often obstruct the factory sights on the muzzle end of the barrel. Sight groove 352 cures the deficiency. In an embodiment, enclosure arms 350 may include an alternative sighting structure similar to those found on the muzzle ends of a firearm barrel.

Referring now to FIGS. 18-21, an embodiment of the present invention, generally denoted by reference numeral 400, includes suppressor 401 having vertical guide receipt 454 to receive vertical guide 418. Vertical guide receipt 454 has width greater than the internal width of vertical guide 418 to allow for lateral adjustment of suppressor 401 with respect to vertical guide 418. Vertical guide 418 attaches to rail attachment 416 similar to embodiments 200-300 and has a similar U-shape to avoid projectile channel 456.

Suppressor 401 includes external accesses 446 leading to vertical guide receipt 454 for receiving fasteners which engage vertical guide 418 to lock suppressor 401 at a desired location in both the X-direction and Y-direction (lateral and vertical directions). Like the previous embodiments, this ability to adjust in generally any direction within a plane perpendicular to rail attachment 416 allows suppressor 401 to axially align with the bore of a firearm barrel.

Vertical guide receipt 454 is preferably a separate chamber from suppressing section 458, which typically includes baffles and other features (not shown) designed to suppress the sound of a gunshot. A separate chamber for vertical guide receipt 454 is not necessarily required for the operation of suppressor 401, but it does prevent the gases from passing through projectile channel 456 and into suppressing section 458 from entering vertical guide receipt 454 and being dispelled therethrough.

For the same reason, suppressor 401 includes projectile channel 456 extending between suppressing section 458 to the proximal end of suppressor 401. Preferably, all the gasses resulting from a gunshot will pass into the suppressing section and be properly handled to reduce the noise associated with said gasses.

Realistically, it is not possible to capture all the gasses exiting the muzzle end of the barrel within projectile channel 456. This is especially true when using a firearm with a floating barrel. When the firearm is fired, the barrel and slide translate proximally and then return back to the firing position when the firearm automatically loads the next projectile. The slight proximal translation of the barrel results in a less controlled discharge of slower moving gasses. Accordingly, suppressor 401 includes residual gas receipt 460 having inwardly sloping walls 461 to direct the gases into exhaust chamber 462. The gases can then exit through exhaust ports 464 in the bottom lateral sides of suppressor 401. Exhaust port 464 preferably discharges the gases in a downward lateral direction and out of the line of sight for aiming purposes. Without residual gas receipt 460, these hot gases would be forced backwards towards the user, which is obviously undesirable for many reasons.

Figure 22:
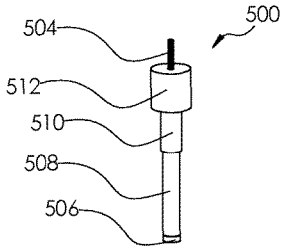
FIG. 22 is a perspective view of the embodiment of the bore alignment guide.
Figure 26:
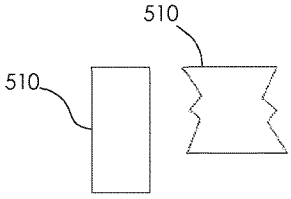
FIG. 26 is an elevation view of an embodiment of the compression sleeve.
Figure 27:
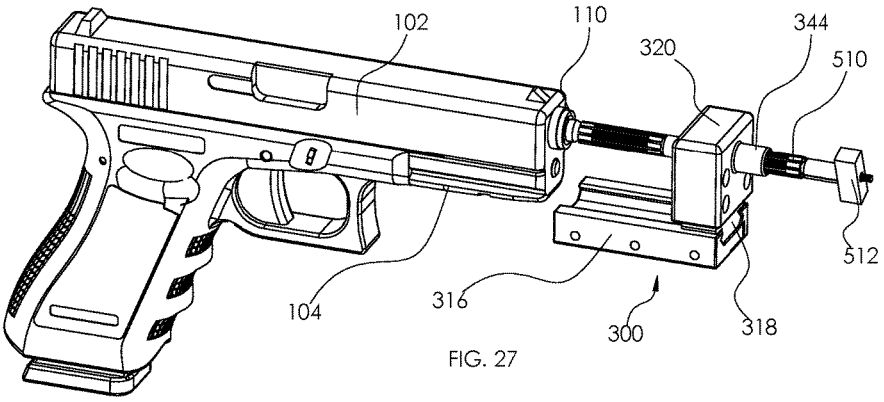
FIG. 27 is a perspective view of the embodiment of the of the present invention.

Referring now to FIGS. 22-29, the present invention may include bore alignment device 500 as a part of an assembly. Bore alignment device 500 includes base rod 502 having threaded end 504 and stop 506 at a second end. Rod 502 is adapted to receive cylindrical compression sleeves 508-510 and threaded compression nut 512. As depicted in FIG. 26, compression sleeves 508-510 are adapted to expand in diameter when compressed in an axial direction. Bore alignment guide 500 can be assembled as shown in FIG. 22, inserted into bore 342 in bore alignment structure 320 and bore 103 in the firearm barrel, and then a user can secure rail attachment 316 to rail 104, as depicted in FIG. 27. A user then compresses compression sleeves 508-510 with compression nut 512 to secure bore alignment guide 500 within bore 342 and firearm bore 103. Bore 342 will become axially aligned with firearm bore 103 when bore alignment guide 500 is secured within both bores. At that point a user can secure bore alignment structure 320 or suppressor 401 to vertical guide 318, 418 and adapter 300, 400 is perfectly set for the particular firearm on which it is attached. Compression nut 512 is then loosened and bore alignment device 500 is removed leaving adapter 300, 400 secured and aligned to firearm 102.

Figure 23:
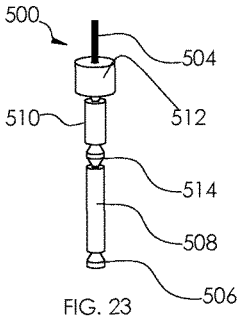
FIG. 23 is a perspective view of the embodiment of the bore alignment guide.

As depicted in FIG. 22, compression sleeve 510 may have a larger diameter than compression sleeve 508 to account for the likelihood that the bore in the bore alignment structure will have a greater diameter than the firearm bore. As depicted in FIG. 23, stop 506 and compression nut 504 may be tapered/conical in shape to aid in expanding the diameters of compression sleeves 508-510. An embodiment also includes intermediate expander 514 having two oppositely arranged tapered/conical features to aid in expanding the diameters of compression sleeves 508-510.

Figure 24:
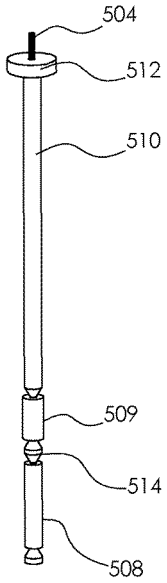
FIG. 24 is a perspective view of the embodiment of the bore alignment guide.
Figure 25:
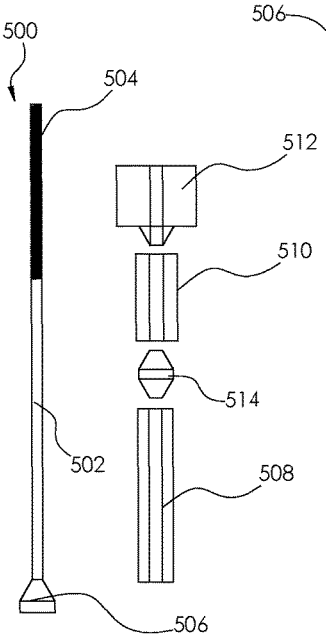
FIG. 25 is an assembly view of the embodiment of the bore alignment guide.

As depicted in FIG. 24, rod 502 and compression sleeves 508-510 may have varying lengths to account for firearms of different barrel lengths.

Figure 28:
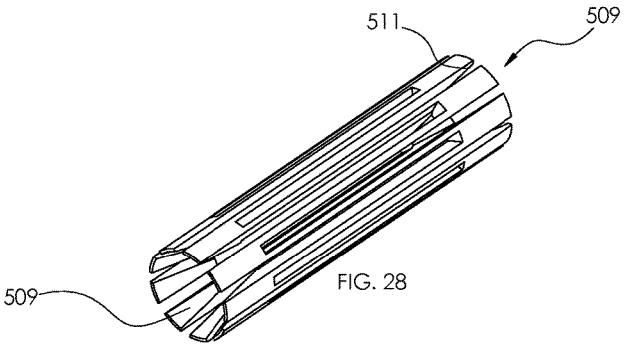
FIG. 28 is perspective view of an embodiment of the compression sleeve.
Figure 29:
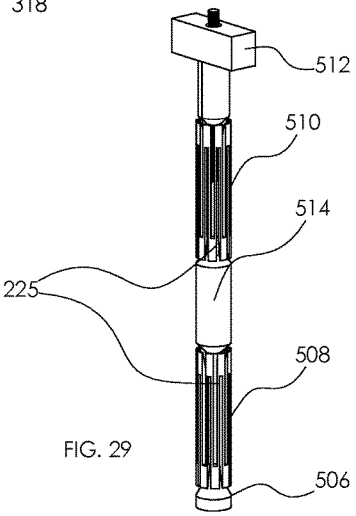
FIG. 29 is a perspective view of the embodiment of the bore alignment guide.
Figure 30:
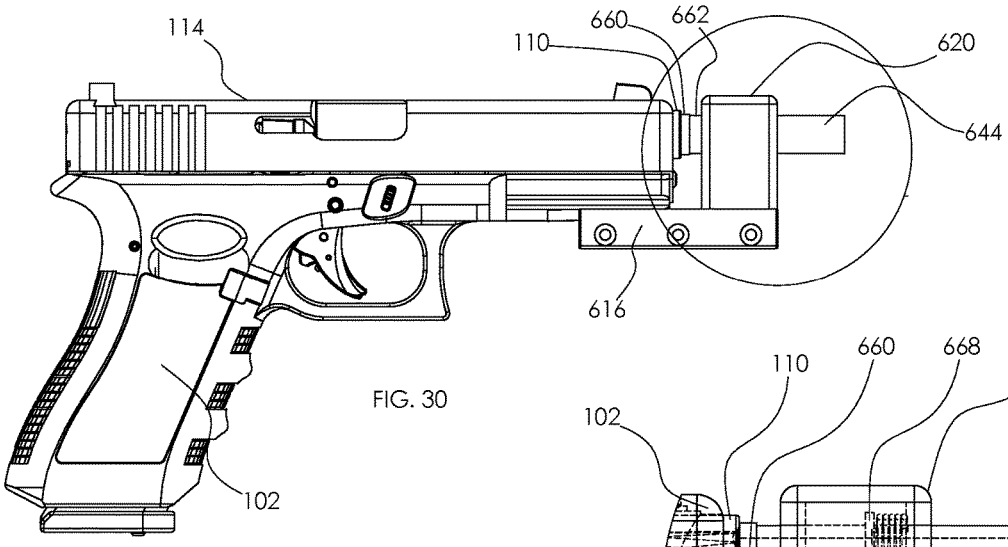
FIG. 30 is an elevation view of the embodiment of the of the present invention.
Figure 31:
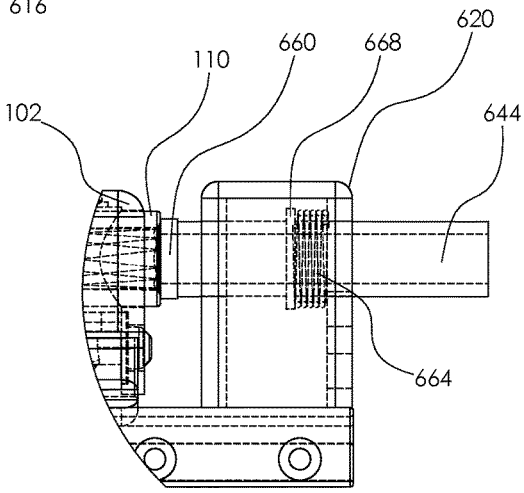
FIG. 31 is a close-up view of the embodiment depicted in FIG. 30.
Figure 32:
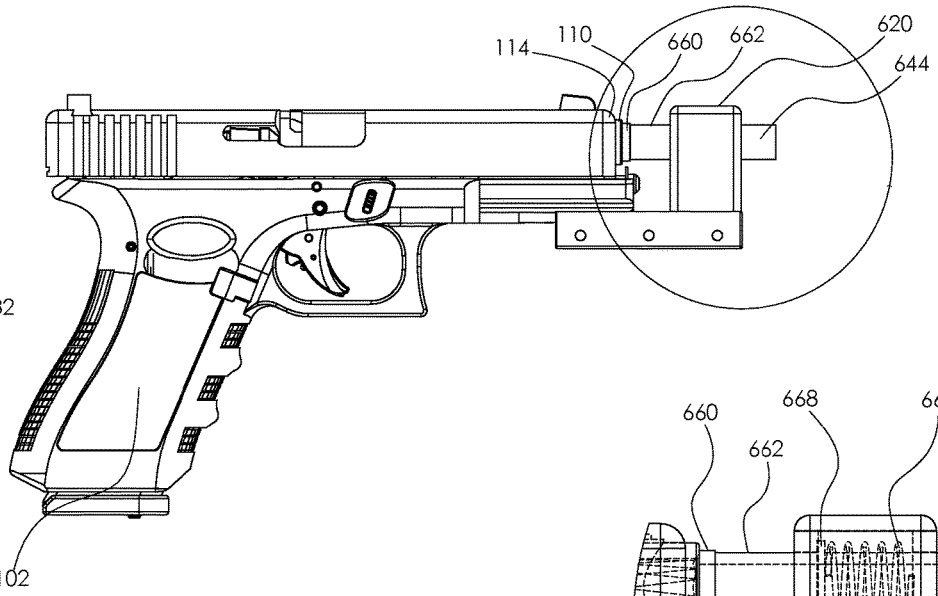
FIG. 32 is an elevation view of the embodiment in FIG. 30 showing the slide in a retracted position.
Figure 33:
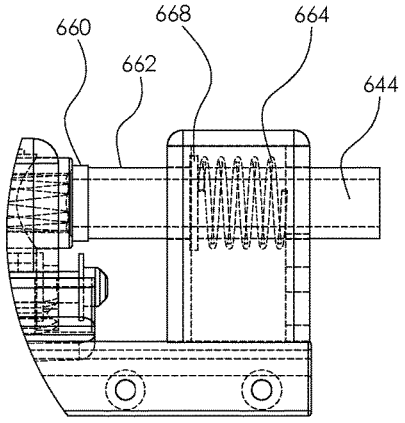
FIG. 33 is a close-up view of the embodiment in FIG. 32.

Referring now to FIGS. 27-29, an embodiment of compression sleeves 508-510 are comprised of a single continuous zigzag shaped sleeve establishing expansion slots 511 such that the sleeve may radially expand. This embodiment of compression sleeves 508-510 includes tapered/conically shaped end receipts 509, wherein the sleeve expands in diameter in response to receiving conical members forced into said end receipts 509.

Referring now to FIGS. 30-33, an embodiment of the present invention, generally denoted by reference numeral 600 includes suppressor mount 644 extending through bore alignment structure 620, such that proximal end 662 of suppressor mount 644 can contact the muzzle end of barrel 110. Embodiment 600 addresses the retraction of floating barrel 110 during the cycling of firearm 102. By the time gunshot gases stops moving through barrel 110, barrel 110 may have proximally retracted by up to $3/16^{th}$ of an inch. Thus, there is a need to maintain a seal against the barrel to allow the slower moving gases to enter the suppressor when barrel 110 retracts with slide 114.

As depicted, proximal end 662 of suppressor mount 644 includes compressible, preferably synthetic, grommet 660 which abuts the muzzle end of barrel 110 under a spring force from biasing member 664. Biasing member, e.g. spring 664, contacts bore alignment structure 620 at the biasing member's distal end and imposes a force against spring platform 668, which is attached to suppressor mount 644. Biasing member 664 ensures that grommet 660 remains in abutting relation to the muzzle end of barrel 110 when the firearm is cycling. As a result, all the gases are forced through suppressor mount 644 and into the suppressor attached at the distal end of suppressor mount 644.

In an embodiment, the internal length (a direction parallel to the longitudinal axis of suppressor mount 644) of bore alignment structure 620 is generally half an inch to ensure that the spring will keep grommet 660 in contact with barrel 110 for up to half an inch of barrel retraction. Bore alignment structure 620, however, can be adjusted in length depending on the cycling distance of the firearm for which it is intended.

Figure 13:
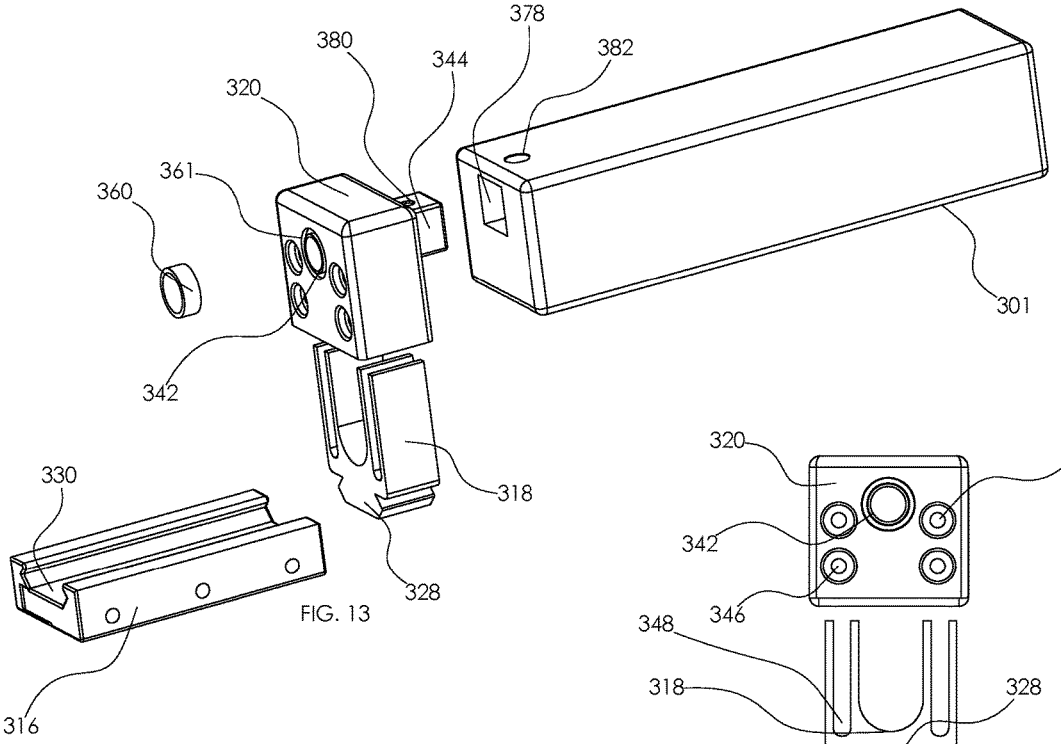
FIG. 13 is an assembly view of an embodiment of the present invention.

An embodiment, as depicted in FIG. 13, includes grommet 360 to cushion the barrel as it travels forward/distally after a gunshot/cycling. In addition, grommet 360 creates a seal between the barrel and bore 342 in bore alignment structure 320. Grommet 360 is preferably a compressible sealing material, such as rubber or another synthetic material. Grommet 360 fits into slot 361 on the proximal face of bore alignment structure 320. Grommet 360 thus allows the barrel to butt up against bore alignment structure 320 without damaging the barrel and cushions the barrel's forward movement when cycling.

In an embodiment, as depicted in FIG. 13, bore alignment structure 318 includes a rectangular suppressor mount 344 having an inner projectile bore for passage of a projectile and an external surface having threaded fastener receipt 380. Suppressor 301, includes rectangular mount receipt 378 and fastener receipt 382 intended to align with threaded fastener receipt 380 when suppressor 301 is mounted on suppressor mount 344. Alternatively, the suppressor mount may include a spring actuated detent on the external surface and a detent orifice on the suppressor for receiving the detent. The suppressor can easily be attached and detached as required or desired by the firearm owner.

Glossary of Claim Terms

Cycle: is a term describing the back and forth movement of the slide of a firearm and in turn the barrel of the firearm.

Detent: is a spring actuated member adapted to engage a detent orifice when in a position of repose and disengage the detent orifice when in a compressed position.

Grommet: is a small hollow structure.

Rail Attachment: is a structure adapted to mount to a firearm frame or rail system on a firearm frame.

Rail Extension: is a lower extension of a firearm rail system.

Suppressor: is a device attached to or part of the barrel of a firearm which reduces the amount of noise generated by firing the firearm.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A firearm adapter, comprising:

a rail attachment having a longitudinal extent and a female mounting channel configured to receive a portion of a frame of a firearm or a rail extension secured to the firearm when the firearm adapter is secured to the firearm;

a bore alignment structure having a suppressor mount extending distally from a distally-facing surface and a bore extending through the bore alignment structure and the suppressor mount, the bore having a central axis that is parallel to the longitudinal extent of the rail attachment;

a vertical guide in mechanical communication with the rail attachment and perpendicularly oriented with respect to the rail attachment; and the vertical guide being in two-directional translational communication with the bore alignment structure, such that the bore alignment structure can planarly translate in both an X-direction and a Y-direction with respect to the vertical guide in a plane perpendicular to the longitudinal extent of the rail attachment to align the central axis of the bore with a central axis of a barrel of the firearm when the adapter is mounted to the firearm.

2. The firearm adapter of claim 1, further including the vertical guide having a male extension extending from a bottom surface and configured to be securely received by the female mounting channel in the rail attachment.

3. The firearm adapter of claim 1, further including a first cam lock and a second cam lock, the first cam lock in communication with a first portion of the female mounting channel and adapted to reduce a width of the first portion of the female mounting channel when the first cam lock is placed into a locking position, and the second cam lock in communication with a second portion of the female mounting channel and adapted to reduce a width of the second portion of the female mounting channel when the second cam lock is placed into a locking position.

4. The firearm adapter of claim 1, further including the bore in the bore alignment structure having an inner diameter equal to or greater than an inner diameter of the barrel of the firearm on which the firearm adapter is mounted.

5. The firearm adapter of claim 1, further including a compressible grommet disposed on a proximal surface of the bore alignment structure and axially aligned with the bore in the bore alignment structure.

6. The firearm adapter of claim 1, further including:

the suppressor mount extending through the bore alignment structure;

a spring platform extending radially outward from the suppressor mount on a portion of the suppressor mount that is located within an inner housing of the bore alignment structure;

a spring disposed between the spring platform and a distal internal surface of the bore alignment structure;

a proximal end of the suppressor mount extending proximally beyond the bore alignment structure and having a compressible grommet secured thereto; and whereby the spring continually forces the compressible grommet into an abutting relation with a muzzle end of the barrel of the firearm when the adapter is mounted to the firearm, such that the grommet remains in the abutting relation as the barrel cycles when the firearm is discharged.

7. The firearm adapter of claim 1, further including the suppressor mount being rectangular and having a detent configured to engage a detent orifice in a suppressor.

8. The firearm adapter of claim 1, further including the vertical guide having a pair of enclosure arms, the enclosure arms extending oppositely around the rail attachment with each enclosure arm having a free end terminating at a longitudinal plane of symmetry about the vertical guide forming a sight line for aiming.

* * * * *